United States Patent [19]

Searcy et al.

[11] 4,286,572

[45] Sep. 1, 1981

[54] VENTILATING HOOD

[75] Inventors: James A. Searcy, Florissant; Roger O. Zoellner, Kirkwood; Ronald C. Hoffmann, Maryland Heights, all of Mo.

[73] Assignee: Cambridge Engineering, Inc., Chesterfield, Mo.

[21] Appl. No.: 18,725

[22] Filed: Mar. 8, 1979

[51] Int. Cl.[3] ..... F21C 15/08; F23J 11/00

[52] U.S. Cl. ..... 126/299 D; 55/DIG. 36; 98/36

[58] Field of Search ..... 126/287.5, 299; 98/36, 98/40 D, 40 DL, 40 V, 40 VM, 115 R; 55/DIG. 36

[56] References Cited

U.S. PATENT DOCUMENTS

| | | | |
|---|---|---|---|
| 2,148,530 | 2/1939 | Burke | 126/287.5 |
| 3,391,629 | 7/1968 | Snell | 98/40 VM X |
| 3,457,850 | 7/1969 | Sweey et al. | 126/299 D |
| 3,543,669 | 12/1970 | Kodaras | 98/40 D |
| 3,890,887 | 6/1975 | Kaufman et al. | 126/299 D |
| 4,047,519 | 9/1977 | Nett | 126/299 D |
| 4,129,121 | 12/1978 | Dorius | 126/299 D |

FOREIGN PATENT DOCUMENTS

| | | | |
|---|---|---|---|
| 2207514 | 8/1973 | Fed. Rep. of Germany | 98/40 D |
| 1246513 | 9/1971 | United Kingdom | 126/287.5 |

*Primary Examiner*—Albert J. Makay
*Assistant Examiner*—Harold Joyce
*Attorney, Agent, or Firm*—Paul M. Denk

[57] ABSTRACT

In a ventilating hood generally for use in conjunction with a heating apparatus, such as a cooker, a housing incorporates both a diverter and a rear support, the two of which join to segregate the incoming air through a supply conduit from the outgoing air traversing through a support arranged filter and into an exhaust outlet. The front wall of the housing, which is spaced from the lower end of the diverter, incorporates a slightly upwardly inclined deflector, which directs substantially all of the air incoming to the hood upwardly and rearwardly directly towards for movement through the filter, and out of the exhaust outlet, and since the air is generally unencumbered by any structure in the path of its flow, it moves in a rather parallel course with the arranged diverter, and rapidly exits carrying the entrained fumes therewith significantly reducing the BTU requirements for operation of this hood. A second deflector functions in cooperation with a first named deflector, and directs a minor segment of the air flow substantially downwardly for creating an air shield above the frontal portion of the heating apparatus, to thereby prevent the escape of any generated fumes from avoiding entrainment with the major flow of air passing through the filter and out of the hood by way of its exhaust conduit.

9 Claims, 4 Drawing Figures

VENTILATING HOOD

BACKGROUND OF THE INVENTION

This invention relates generally to means for ventilation of a space of air, and more specifically pertains to a novel ventilating hood that both rapidly conveys away all objectional fumes, vapors, smoke, and the like, from within the vicinity of a cooking apparatus, and at the same time prevents the escape of such fumes from the capturing influence of the air flowing through the said hood.

A great variety of ventilating and cleaning apparatuses have long been available in the art, many of them principally for use in conjunction with a cooking apparatus, and for eliminating the generated fumes customarily arising from the same. Such apparatuses are shown in the United States patent to Sweet, et al, U.S. Pat. No. 3,837,269, and to Nett, U.S. Pat. No. 3,978,777. As can be seen, these apparatuses generally incorporate some form of an air hood that diverts the incoming air through a filter while capturing fumes within the course of their air flow for eventual exhausting of the combination to the atmosphere. One concern with these type of ventilators is that they usually consume too much of the tempered air to operate effectively.

The United States patent to De Rosa, U.S. Pat. No. 3,285,154, discloses a ventilating hood wherein all of the incoming air is diverted directly downwardly, and with the exhaust conduit being arranged forwardly thereof, operates to absorb both the incoming air and previously tempered air within the room, for exhausting to the atmosphere, and thereby adding to the cost for operation of the shown assembly.

The U.S. Pat. Nos. to Kuechler, 3,664,255, and 3,943,836, disclose another form of a smoke hood, of the vortex-type, and these styles of hoods are designed for causing a swirling action for the flow of air venting the hood, and which supposedly has a tendency to entrain the cooking fumes within the vortex by way of exhausting. But, once again, the operations of such a device are generally less efficient in causing grease accumulation on the filter and the immediate area due to the continuous air swirling pattern. In addition, it is necessary that the blowers of much greater capacity than customarily used must be operatively associated within the respective supply inlets and exhaust outlets for such hoods.

Other styles of ventilating systems for use in buildings, such as restaurants, or the like, are shown in the earlier United States patent to Brown, U.S. Pat. No. 3,800,689, Courchesne, U.S. Pat. No. 3,530,784, Jansen, U.S. Pat. No. 3,400,649, Ahlrich, U.S. Pat. No. 3,411,428, Ahlrich, U.S. Pat. No. 3,645,194, and finally, U.S. patent to Vandas, U.S. Pat. No. 4,022,118. It is submitted that the construction of the ventilators and hoods shown in these type of prior art patents are quite different in their operations and structures, and the results obtained therefrom, in comparison to what is revealed in this current application.

In view of the foregoing, it is the principal object of the invention to provide a ventilating hood that functions highly efficiently in removing fumes from the vicinity of a cooking apparatus, while at the same time utilizing minimum energy requirements in its operation.

Another object of this invention is the unique arrangement of supply and exhaust air streams which are directed by a particularly designed ventilating hood in minimal movement for providing an efficient means for the combination capture and removal of objectional fumes or the like.

Another object of this invention is to provide for a split or segregated stream of supply air for a ventilating hood, one said stream acting as a primary air flow for substantially entraining and removing the fumes from the cooking apparatus therebelow, while a minor segment of the air flow which functions as a secondary air stream acts to create a shield at the forward edge of the cooking apparatus for preventing the escape of fumes to the ambient air of the room in which it is located, and at the same time providing a shield of cool air that shelters the chef from the excessive heat and abnormal cooking flare-ups that occur on the cooking apparatus.

Another object of this invention is the provision of uniquely arranged grease traps and a grease collector that have a tendency to govern the flow of any grease adhering to the hood elements and divert their movement into position for removal.

Yet another object of this invention is to provide a ventilation hood that functions to furnish a direct and convenient flow of the fresh supply air directly through the hood and to its exhaust outlet, said air being substantially untempered due to its direct flow, while at the same time, requiring a considerable lesser quantity of tempered air than heretofore required during the operations of related ventilators in the prior art.

Another object of this invention is to provide a ventilating hood that significantly reduces the BTU requirements needed during its performance.

Another object is to prevent grease collection and condensation on the hood surfaces, particularly at its diverter, due to the establishment of a boundary air layer on the exposed surfaces and through which the cooking smoke, grease, and fumes cannot penetrate.

These and other objects will become more apparent to those skilled in the art upon reviewing the summary of this invention, and upon undertaking a study of the description of its preferred embodiment, in view of the drawings.

SUMMARY OF THE INVENTION

This invention contemplates the structure of a ventilating hood incorporating a minimum of structural components, and which is designed principally for significantly reducing the energy requirements, including BTU consumption, and to achieve a highly effective operating hood that not only completely ventilates the fumes generated from a cooking apparatus generally arranged downwardly therefrom, but in addition, conveniently shields against the convection of heat towards the room in which the apparatus is located for usage. As an example of the reduced energy requirements for operation of an apparatus of this design, the invention utilizes a significantly reduced air flow from the entrance therein to the hood and through to its filter for exhausting by way of the exhaust outlet. This exhaust system is desirably maintained at approximately fifty cubic feet per minute per foot of length for the hood for the tempered air. And, while the hood may be of variable widths, the BTU consumption for a hood of the preferred embodiment, of approximately ten feet in length, consumes in the vicinity of 35,000 BTUs per hour. This is so because of the bulk of the circulating air remains significantly untempered from its entrance into the hood until it is exhausted, is free of any significant swirling or urging downwardly as frequently is designed into the prior art type of hood. In fact, the energy consumption of this hood is only about twenty percent of that required for the conventional hoods now in use. Thus, as previously explained, for a hood of approximately ten feet in length, with an air flow in the vicinity of 50 cubic feet per minute of tempered air, the remaining make up air coming from the hood structure, the BTU consumption is in the range of the 35,000 BTUs per hour. This is so where the ambient atmosphere may dip below freezing. On the other hand, in the prior art type of hood, a typical tempered air flow through the hood is in the range of 350 cubic feet per minute per foot, and for a ten foot wide hood, by way of example, its BTU consumption is in the vicinity of 245,000 BTUs per hour. Thus, the efficiency in the lack of BTU consumption in the operations of the hood of this invention, without even giving consideration to the lesser horsepower requirements for the motors which are used for the blowers of the inlet and exhaust ducts is approximately 210,000 BTUs per hour. Hence, significant efficiency in less power consumption alone and much lesser BTU requirements can be obtained through the usage of the particular ventilation hood of this design.

In the process of operating the ventilating hood of this invention, a greater percentage, generally eighty percent, of the incoming air furnished to the supply intake is directed substantially paralled with the diverting means that initially directs the air toward the front of the hood, with a parallel flow of the air being channeled directly towards the filter for the hood for passage therethrough, and its immediate withdrawal into the exhaust outlet for discharge to the outside atmosphere. Thus, this tempered air flow is at a significantly lesser velocity than that employed in prior art hoods, in sending the air flow directly towards the exhaust outlet without any of the disruptive factors influencing its flow as designed for in the prior art. And, to insure that all of such fumes are properly exhausted from the vicinity of the cooking apparatus, a small or minor segment, generally less than 10% to 12% of the incoming air flow, is deflected downwardly to create a thin layer shield of such air which has the tendency, as just previously described, to create a shield that maintains the restriction of the fumes within the attraction of the ventilating hood, thereby preventing the fumes and heat from disseminating outwardly into the vicinity of the kitchen or other room in which the cooking or heating apparatus is installed. At the same time, such an air shield, composed of air which is normally drawn in from the exterior of the building, particularly during the cooler temperature months, creates a barrier for the chef against his exposure to the heat and fumes generated by the cooking apparatus during its operation. Hence, not only does such an air shield, which is created in a manner that maintains its minimal existence just frontally of the cooking apparatus, have a tendency to maintain the confining of the fumes and directing their natural movement upwardly into the vicinity of the ventilating hood, but likewise, acts for the convenience of the chef by preventing his continuous exposure to the excessive heat arising from the burners or charcoals of the said cooking means.

The inventive aspects of the structured relationship of this ventilating hood and which achieves the desired attributes particularly in energy savings include the arrangement of a diverting means, in the form of an inclined plate, that deflects the incoming air supply towards the front of it, with the spaced arrangement between the front wall and diverting means creating a particularly sized passage through which the air flow is turned approximately 180° and back upwardly along the underside of the said plate for parallel flow directly towards the filter for the hood. This air flow gives rise to the Coanda effect which shields the underside of the diverting means against the accumulation of grease, etc., as by way of condensation. Once this air flow passes through the filter, it is immediately exhausted from the hood and into the atmosphere, or elsewhere. And, since there is little or no further reorientation of this air flow during its passage through the hood, particularly in the vicinity where the fumes rising from the cooking apparatus are captured, the flow of this air can be significantly reduced down to a minimum but sufficient to attain its desired flow directly toward the filter, as previously explained. Prior art apparatuses, as heretofore analyzed, prefer to cause a circulation or vortexing of the air which previous designers deemed necessary to obtain proper ventilation from hoods of these designs.

To create the air shield as previously explained along the front of the spacing between this hood and the heating apparatus arranged therebelow, upon the deflecting means, as described, a second deflecting means is spacedly secured and functions to divert a minor segment of the air flow generally in the direction downwardly and just below the region of the front of the installed hood. But, even this small quantity of air functions to create the desirable curtain in this vicinity of the front of the hood, and below the same, for the purpose as previously analyzed. And, such air as it reaches the lower extent of its travel has a tendency to turn and blend into the flow of the rising fumes from the cooking apparatus, and also eventually become entrained within the primary air flow of the hood as previously explained for discharging by way of its exhausting through the exhaust blower of this apparatus.

BRIEF DESCRIPTION OF THE DRAWINGS

In the drawings, FIG. 1 discloses a partial side view of the ventilating hood of this invention connecting with its supply and exhaust conduits.

DESCRIPTION OF THE PREFERRED EMBODIMENT

Figure 1:
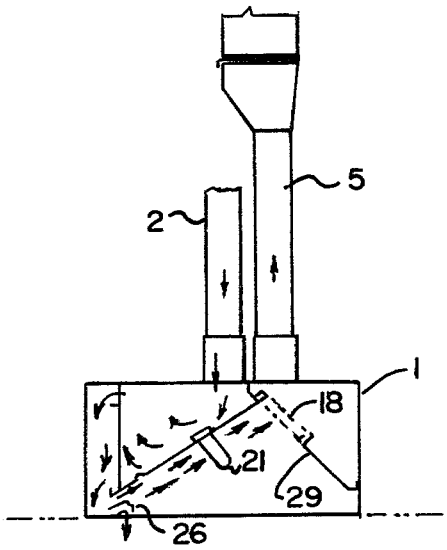
Figure 2:
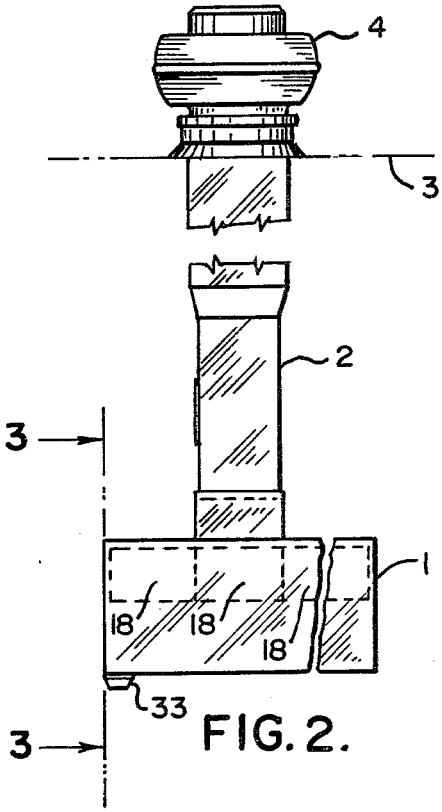
FIG. 2 furnishes a front view of the ventilating hood of FIG. 1, and also showing one of the blowers mounted upon the roof of the structure in which the hood is installed.

In referring to the drawings, in the particular FIGS. 1 and 2, there is shown the ventilation hood 1 of this invention, and which hood has been substantially designed with the feature in mind that it can operate at much lesser energy requirement, but due to its unique construction and operation provides for a rapid withdrawal of any captured heat within the confines of the hood for immediate exhausting so as to substantially reduce the exposure of the hood to the rising heat and thereby maintain a low temperature profile during its operations. As can be seen, the hood incorporates an upwardly extending air supply conduit 2 and through which the incoming supply of air, generally from the exterior of the building upon which the hood is mounted, is continuously drawn into the confines of the hood for ventilation purposes. As can also be seen, particularly in FIG. 2, the supply air conduit 2 extends upwardly through the roof 3 of the building in which the unit is installed, and maintains its blower 4 erected thereupon for the purpose of inducting air into the apparatus. Likewise, a second conduit 5 connects with the hood and extends upwardly therefrom, generally through the same roof 3, and mount its exhausting fan also exteriorly of the building, and usually at a point significantly remote from the intake blower 4, so that the exhausting air will not be comingled with the fresh air drawn into the hood of this invention. These type of features for supplying an exhausted air with respect to the ventilation hood are rather customarily used in the art.

Figure 3:
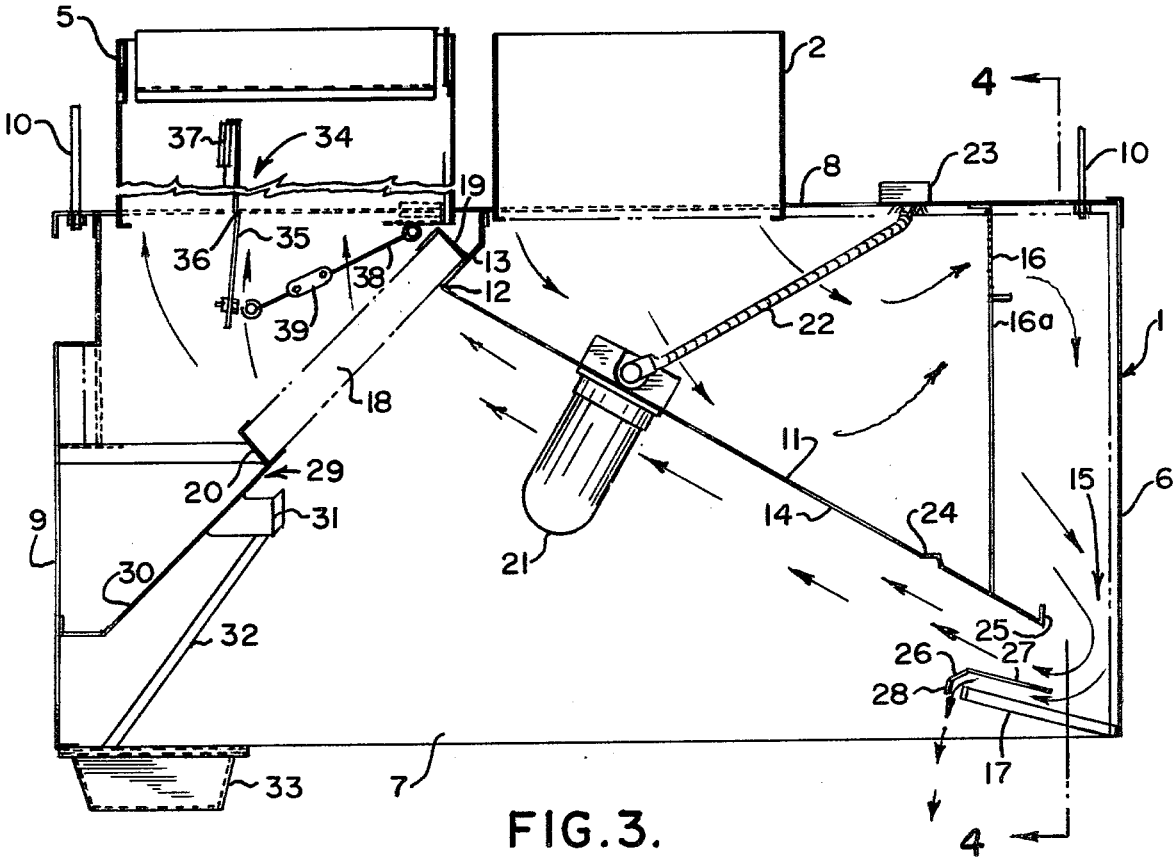
FIG. 3 provides an enlarged side view of the ventilating hood of this invention, taken along the line 3—3 of FIG. 2.

As can be seen in FIG. 3, the general construction of the ventilating hood of this invention is shown, and it incorporates a housing having at least front and side walls 6 and 7, respectively, and may also include a top wall 8 in addition to a back wall 9 so as to complete the enclosure of the housing that basically internally mounts all of the remaining components of this operating ventilating hood. The housing, as formed of these walls, may be suspended by means of the hangers 10 so as to maintain the hood at a convenient height above the cooker, or other heating means (not shown), that is generally arranged below such a hood, with the hood providing the means for the direct access and collection or capturing of the fumes and smoke elevating from the cooker upwardly in and through the ventilation hood for removal.

Figure 4:
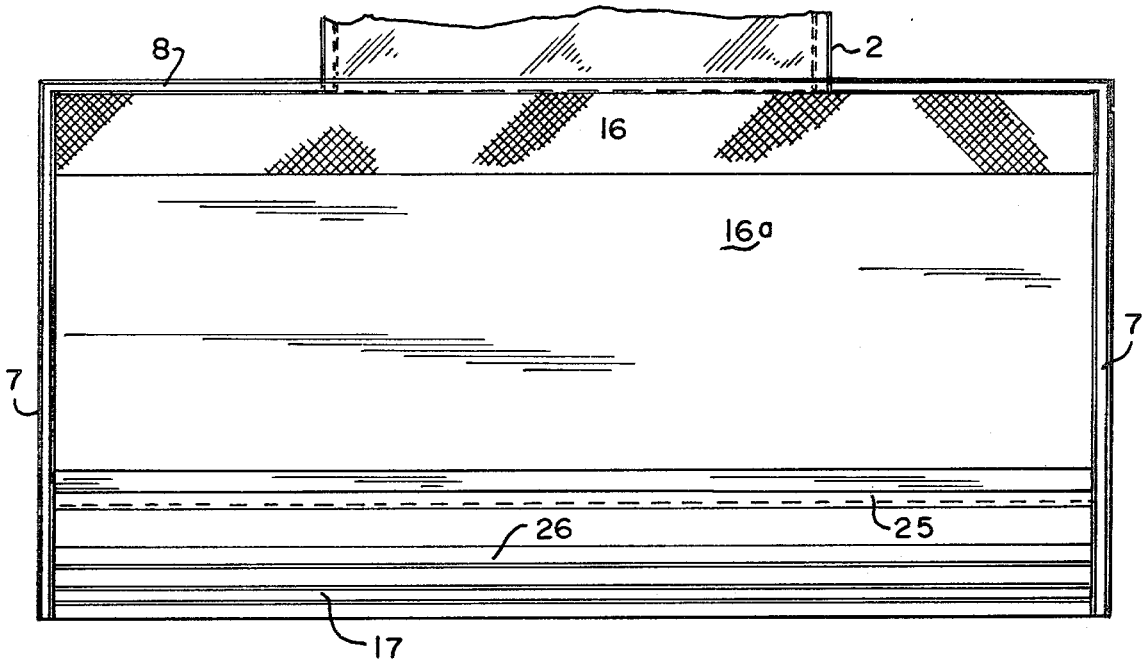
FIG. 4 provides a sectional view taken along the line 4—4 of FIG. 3, disclosing the front edge of the diverting means, first and second deflecting means, and the diffuser supporting the frontal edge of the said diverting means.

Interiorly of the housing of the hood are the various components that effectively rearrange the air passing through the same so as to provide for a maximum entrainment of the rising fumes to achieve their removal, and at the same time do so with a minimum of air flow velocity so as to lessen the energy requirements needed to sustain the continuing operations of this type of hood. As can be seen, a diverter means 11 interconnects at its upper end, as at 12, with the top wall of the housing, and doing so through the structure means 13, with said diverter extending a significant distance, as at 14, for arrangement upon an incline downwardly towards the front of the hood. This forward incline of the diverter means is substantially planar in configuration, and acts as a guide for directing the incoming air flowing through the supply duct inlet towards the front of the housing wherein it traverses through a narrow neck passage, as at 15, after passing through a diffuser 16 that has a tendency to disseminate the flowing air over the full width and height of the front of the housing. This diffuser 16, as more accurately shown also in the FIG. 4, may be formed, as in the preferred embodiment, of an expanded metal, which functions not only as the means for scattering the flowing air coming into the hood, but likewise, provides structural support for the frontal edge of the diverter means 11, and furnishes the means for supporting the arrangement of the said diverter at this location. The lower part of the diffuser comprises a plate 16*a*, that reinforces the hood at its frontal portion. Mounted to the lower front edge of the wall 6 is a deflecting means 17 which functions to redirect the inflowing air into a turn of approximately 180°, for flowing, once again, upwardly along the underside of the said diverter means, in substantially parallel flow therewith, and directly towards and through the filter 18 of the hood. And, the flow of the air will be somewhat enhanced in its velocity as this point directly below the diverter means, which is achieved due to the condensed passage of the flowing air through the said narrow passage 15, as previously explained, which has a tendency to function in the nature of a venturi that speeds up the air flow as the capacity of the flow path is reduced in size. This can be readily understood by reviewing the ample spacing provided directly above the diverter means 11, within the hood, as compared with the narrow spacing provided for the passage of the air through the diffuser 16, and the passage 15, which by necessity, significantly enhances the velocity of the air passing therethrough. Generally, the air as this location will be traveling somewhere within the vicinity of two hundred to two hundred fifty cubic foot per minute per foot of length of the designed hood, with only approximately fifty cubic foot of tempered air coming from the room. When one considers, as previously explained in the summary of this invention, that standard ventilating hoods of related designs provide for the flow of heated air within the vicinity of 350 cubic feet per minute per foot of length of the hood, with most of it being tempered room air, the current invention significantly reduces the air requirements by operating at tempered air flows within the vicinity of one-seventh of that customarily designed into a hood of this type. It is also to be noted, as previously explained, that this air flow forms the desired air shield at the underside of the diverter means 11.

The filter means 18 of this invention is intentionally designed being of rather lessened height, usually less than 12 inches in height, and as can be seen, its height from its upper end 19 to its lower end 20 is substantially less than half the overall length of the diverter means 11, and therefore, such has a tendency to effect a greater attraction and draw of the flowing air, passing along the underside of the planar means 11, immediately towards and directly through the filter 18, thereby substantially eliminating any possibility of vortexing, turbulence, or deflection for the flow of such air as it passes to and through the identified filter. As previously explained, the exhaust conduit 5 incorporates an exhaust fan that effects this direct attraction of the exhausting air to the filter and out of the apparatus for discharge to the atmosphere. As can be seen, since the diverter means 11 is arranged upon an upward incline towards the rear of the apparatus, any fumes arising up from the heating apparatus arranged therebelow, as previously explained, become immediately entrained within this air flow and removed from the hood without hesitation, mainly due to the strong suction flow field established by the reduced filter height.

The filter of this invention is of a particular design from a dimension standpoint, having the lessened height as previously explained, but may have substantial width, since the width of this hood may extend to as great as 10 to 20 feet, thereby necessitating the use of a plurality of adjacent filters within the same to function as a filtering medium for the removal of any grease or the like from the entrained fumes as they pass out of the hood.

As can further be seen from FIG. 3, a light source 21 incorporating a covering globe, as shown, mounts for illuminating the underside of the hood in the vicinity of the diverting means or plate 11, and has its electrical charge conducted to it by means of the conduit 22 which connects, at its other end, to an externally mounted junction box 23. In addition, the downward end of the diverting plate 11 incorporates a slight double bend, and as at 24, and this bend acts primarily in the nature of a stiffener, and also as a grease barrier that prevents the flow of any liquified grease any further downwardly upon the underside of the plate 11, in the slim event that any grease should get through the air flow barrier. And, since one leg of this bent area 24 rises slightly upwardly from the horizontal, the grease cannot flow past this grease joint as it moves along the underside of the plate 11. Furthermore, the downward end of the diverting means 11 is bent into an angular configuration, as at 25, and therein functions to act as a stiffener for reinforcing the downward edge of this diverter.

Connecting onto the upper and rearward edge of the deflecting means 17 is a second deflecting means 26, and this deflecting means includes integral segments that, in the first instance, are arranged parallel and raised slightly above the deflecting means 17, as in the vicinity of its element 27, and that which extends rearward is bent downwardly, into the arrangement as shown at 28, and which functions to divert a minor segment of the flowing incoming air downwardly in the direction as shown by the flow line arrows, providing for the creation of the air shield, as previously explained, along the frontal edge of the hood and any cooking apparatus arranged therebelow, for providing the two-fold purpose as previously summarized within this invention. Briefly, such minor air flow forms a shield that provides a cooled barrier between the heat rising from the cooking apparatus and the chef or operator standing forwardly of the same, and in addition, acts as a means for encapulating the rising fumes so as to insure that they enter into the region of the ventilating hood, and become entrained and flow with the air that is being drawn out through the filter 18. In practice, it has been found that diverting less than twelve percent of the air by means of the deflecting means 26 downwardly effectively creates the desired amount of air curtain to achieve the enhanced results desired from this invention. As can be understood, the various components internally arranged within the ventilating hood of this invention, such as the diverting means 11, and the deflecting means 17 and 26, all extend the full width of the ventilating hood so as to provide for the creation of the air flow and shield throughout its width, so that this type of venting means may be used effectively also where a bank of cooking apparatuses or stoves are used, such as in larger capacity restaurants. The hood of the preferred embodient, as described herein, may be approximately 10 feet in length, but it is equally appropriate that a hood up to 20 feet in length or more may also be used and constructed in accordance with the teachings of this invention, and operated just as effectively. The diffuser 16, as previously explained, is designed to provide for a slight interruption to the flow of air around and through the narrow passage 15, and to provide for the dissemination of the air throughout the entire width of the constructed hood. And, likewise in the preferred embodiment, a hood of approximately twenty or more feet in length may be serviced by only a single supply inlet and exhaust duct, and therefore, there is a need for such a diffuser, such as the diffuser means 16, for effectively spreading the flow of air throughout the entire width of the ventilation hood.

The filter 18 is embodied within a rear support 29 of the hood structure, and this rear support includes an inclined plate, as at 30, that extends upwardly from its mounting to the back wall 9 of the hood, while at its upper end it is bent in the shape of a guide, as shown at 20, so as to embrace the lower end of the filter means 18. Likewise, the rear support provides at its upper end a similar type of guide 19, connecting onto the means 13, so as to hold the upper end of the filter means 18 in place, as can be seen. Mounted upon the rear support is a trough 31, which is conveniently exposed extending and cnnecting approximately the width of the filter means support, and thereby functioning to collect any of the dripping grease that is captured by the filter. Since this grease trough is within the path of the rising heat, the collected grease remains fluid, due to this slightly elevated temperature of the air continuously passing upwardly through the filter in carrying the accumulated fumes away from the vicinity above the heating apparatus. The conduit 32 interconnected with the trough 31 extends downwardly to a collector 33 wherein the accumulation of the grease may be deposited for eventual and periodic removal.

Under various codes it becomes a requirement that should any fire be untimely ignited within the vicinity of this type of ventilating hood, the fire must be confined to the hood and not be allowed to escape from the same through its air drawing duct 5. For this reason a damper 34 is provided across the exhaust duct opening that allows access into the exhaust duct 5, and this damper comprises a plate 35 that is pivotally mounted, as at 36, having a weight 37 mounted to its upper end. In the lower end of the damper plate 35 there is attached a cable, as at 38, and which cable connects permanently at its other end with the top wall structure of the hood. Incorporated within the cable is a heat fuse 39, which fuse comprises a heat meltable material which when exposed to heat of a certain degree, or flame, does melt and separate, thereby breaking the retaining power of the cable 38, and allowing the damper, under the influence of its weight 37, to close, preventing any further access into the confines of the exhausting duct 5. This damper is shown in hidden line in closure in FIG. 3. Thus, should any grease fire or other type of flame be generated within the ventilating hood, and its fuse 39 become separate, the damper will close, curtailing any further access particularly of fire into and through the exhaust conduit 5. The exhaust conduit, as well as the intake duct 2, may undertake a variety of shapes in the capacity of a round duct, or even rectangular in shape, and therefore, the damper itself will be formed into a corresponding shape to that of the exhaust duct 5 itself so as to provide full closure across the access into the inlet conduit 5.

Various modifications or variations within the design of the hood of this invention may occur to those skilled in the art upon reviewing the subject matter of this invention. Such variations, if within the spirit of the invention, are intended to be encompassed by any claims to patent protection issuing hereon. The description of the preferred embodiment is set forth for illustrative purposes only.

Having thus described the invention, what is claimed and desired to be secured by Letters Patent is:

1. A fume ventilating hood for use in conjunction with a heating apparatus or the like for attaining ventilation in the region upwardly of such an apparatus and for removing its generated fumes, comprising, a housing, said housing having at least front and side walls, a top structural means for the housing, said top structural means comprising the top wall of the apparatus, a supply inlet communicating with said housing for conveying fresh air to the same, and an exhaust outlet also communicating with the housing for removing the combined air and fumes from the region above the apparatus, a diverter means for the housing and interconnecting between the said inlet and outlet and being uniformly singularly planar in configuration and useful for directing the incoming fresh air towards the front of the housing, a rear support for the housing and connecting in proximity with the said exhaust outlet, a shallow filter held by the said rear support, said diverter means being inclined in its positioning within the hood, with the upper end of said diverter means being located in proximity with the rear support, while the lower end of said diverter means being disposed proximate the front of the said housing, a diffuser means interconnecting between the top wall of the apparatus and the approximate lower segment of the diverter means, said shallow filter being substantially less than one half of the length of the diverter means, the upper end of the diverter means terminating within the region directly in front of the said filter so as to provide for the unencumbered flow of the accumulated air and fumes directly into the exhaust outlet without any obstruction other than that provided by the said filter, and a deflecting means connecting approximately at the lower front of the housing and spaced from the lower edge of the diverting means and useful for redirecting the diverted incoming air directly towards the outlet disposed filter in parallel flow with the underside of the uniformity singularly planar diverter means for creation of an air boundary layer therewith without generating any substantial vortexing of said air for its eventual exhausting of the now combined air and fumes from the said hood, said deflecting means extends rearwardly from its connection with the lower end of the front wall and in a direction inclined substantially approximately towards the said filter, a second deflecting means arranged in proximity with the said first named deflecting means and forming an air space therebetween of substantially small dimensions than the space between the lower edge of the diverter means and said first deflecting means, said second deflecting means including a first part arranged substantially in parallel and upwardly of the first deflecting means, and a second integral part extending substantially downwardly for diverting a minor segment of air flowing therethrough in a direction downwardly of the hood, said second deflecting means being useful for directing said minor segment of the flowing air substantially downwardly for forming an inner shield in the front of the apparatus and for confinement of its heat thereby enhancing its attraction to the exhaust outlet of the hood.

2. The invention of claim 1 and wherein said top, front, and side walls are insulated.

3. The invention of claim 1 and wherein said diffuser being formed from expanded metal.

4. The invention of claim 1 and wherein the diffuser means disseminates air only through its upper segment.

5. The invention of claim 1 wherein less than twelve percent of the incoming air is deflected downwardly by the second deflecting means.

6. The invention of claim 1 and including a grease barrier means provided in the lower segment of the uniformly singularly planar diverter means and useful for preventing the downward flow therepast of any accumulated grease flowing upon the underside of the diverter means, said barrier means comprising an integral transverse bend provided in the diverter means slightly upwardly from the bottom of the inclined diverter means, with said vent having at least one portion extending angularly upwardly above the horizontal so as to curtail the flow of any grease therepast.

7. The invention of claim 6 and including a stiffener formed transversely along the lower edge of the planar diverter means and useful for strengthening of said means at this location.

8. The invention of claim 1 and including a grease trough provided upon the rear support and arranged below the said filter for receiving grease and other drippings from the said filter during operation of the said hood, and a grease collector provided downwardly of the said trough, a conduit communicating between said trough and collecter and functioning to drain any trough accumulated grease into the said collector.

9. The invention of claim 1 and including a dampener pivotally mounted across the entrance into the exhaust outlet, connecting means for suspending the said damper into its open position, a heat sensitive fuse means provided in the said collecting means and when ruptured through exposure to excessive heat providing a closure of the dampener and a curtailing of any further exhausting of air from the hood, and a weight means provided upon the dampener and useful for effecting a rapid closure of the exhaust outlet after heat rupture of its connecting means.

* * * * *